US012276118B2

(12) United States Patent
Demuth et al.

(10) Patent No.: US 12,276,118 B2
(45) **Date of Patent: *Apr. 15, 2025**

(54) HIDDEN CLIP FOR DECKING

(71) Applicant: MN Fastener LLC, Paynesville, MN (US)

(72) Inventors: Nicholas J. Demuth, Cold Spring, MN (US); Mark T. Reum, Avon, MN (US)

(73) Assignee: MN Fastener LLC, Paynesville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/135,602

(22) Filed: Apr. 17, 2023

(65) Prior Publication Data

US 2023/0250645 A1 Aug. 10, 2023

Related U.S. Application Data

(63) Continuation of application No. 17/145,314, filed on Jan. 9, 2021, now Pat. No. 11,629,509.

(51) Int. Cl.

| | |
|---|---|
| ***E04F 21/22*** | (2006.01) |
| ***E04F 15/02*** | (2006.01) |
| *E04B 1/00* | (2006.01) |

(52) U.S. Cl.

CPC ..... *E04F 15/02044* (2013.01); *E04B 1/003* (2013.01); *E04F 2015/02094* (2013.01); *E04F 21/22* (2013.01); *E04F 2201/05* (2013.01)

(58) Field of Classification Search

None

See application file for complete search history.

(56) References Cited

U.S. PATENT DOCUMENTS

| | | | | |
|---|---|---|---|---|
| 7,533,500 | B2 * | 5/2009 | Morton | B29C 48/12 52/480 |
| 8,615,958 | B2 * | 12/2013 | Kilgore | E04F 15/02044 52/650.3 |
| 9,422,728 | B2 * | 8/2016 | Gamble | E04F 13/0846 |
| 9,822,809 | B2 * | 11/2017 | Shadwell | F16B 15/0038 |
| 2010/0205895 | A1 * | 8/2010 | Orchard | E04F 15/02 52/712 |
| 2014/0165491 | A1 * | 6/2014 | Lachevrotiere | E04F 15/02044 52/489.1 |
| 2014/0186109 | A1 * | 7/2014 | Wadsworth | F16B 11/006 403/404 |
| 2014/0260043 | A1 * | 9/2014 | Cottier | E04F 13/16 52/489.2 |
| 2017/0037643 | A1 * | 2/2017 | Mitchell | E04F 13/0846 |
| 2017/0058534 | A1 * | 3/2017 | Engström | E04B 9/0435 |
| 2017/0106513 | A1 * | 4/2017 | Orchard | B25C 1/001 |

(Continued)

FOREIGN PATENT DOCUMENTS

| | | | | |
|---|---|---|---|---|
| WO | WO-2015196108 | A1 * | 12/2015 | B25B 23/06 |

*Primary Examiner* — Phi D A

(74) *Attorney, Agent, or Firm* — Skaar Ulbrich Macari, P.A.

(57) ABSTRACT

A plurality of hidden clips can be included with a strip of clips and separated by a frangible section or tab located between adjacent clips. An aperture defined in each hidden clip can include an offset cylindrical section that causes a fastener to pivot from a vertical alignment when the fastener is driven into a joist. Each strip can be provided with a hand grip portion removably attached to a proximal-most hidden clip in the strip of clips.

20 Claims, 7 Drawing Sheets

(56) References Cited

U.S. PATENT DOCUMENTS

| | | | | |
|---|---|---|---|---|
| 2018/0223547 | A1* | 8/2018 | Demuth | B25C 7/00 |
| 2019/0309527 | A1* | 10/2019 | Bergelin | E04B 1/003 |
| 2020/0217084 | A1* | 7/2020 | Ylikangas | E04F 15/02005 |

* cited by examiner

HIDDEN CLIP FOR DECKING

PRIORITY

This application is a continuation of U.S. patent application Ser. No. 17/145,314, filed Jan. 9, 2021, which is incorporated herein by reference in its entirety.

FIELD

The present invention generally relates to building construction, and more particularly to hidden clips used to secure decking materials in place.

BACKGROUND

Extruded decking boards, composite boards, milled wood planking, and the like, may utilize fasteners such as hidden clips to fasten them in place. These hidden clips consist of a body that may be of molded plastic or stamped metal, and have a screw, nail, or formed tab inserted in it.

During use, the hidden clip is inserted into the groove on the board's longitudinal edge and the fastener is driven through the hidden clip into the joist supporting the board and hidden clip, fastening the board edge to the joist. This is a labor-intensive process since the user must hand position each individual hidden clip, hold it in place with one hand, and nail or screw the fastener with the other hand. This hand feed technique is slow and requires two hands. When a board is on an incline or requires force to position it, two persons may be required to lend the third hand to hold it in the correct position while the hidden clip and fastener are secured.

There is a continuing need for improved hidden clip configurations for installing decking.

SUMMARY

A plurality of hidden clips can be included with a strip of clips and separated by a frangible section or tab located between adjacent clips. Each strip can be provided with a hand grip portion removably attached to a proximal-most hidden clip in the strip of clips. An aperture defined in each hidden clip can include an offset cylindrical section that causes a fastener to pivot from a vertical alignment when the fastener is driven into a joist.

In certain example embodiments, a hidden clip for deck board fixation can comprise a head portion extending horizontally to define a first edge and a second edge, a stem portion extending downwardly from the head portion, and a center aperture defined through the head portion and the stem portion. The center aperture can define a plurality of cylindrical portions. A first cylindrical portion can be horizontally offset from a second cylindrical portion such that a centerline of the first cylindrical portion does not align with a centerline of the second cylindrical portion.

A first compression tab can extend vertically downwardly from the stem portion. A second compression tab can extend vertically downwardly from the stem portion. The second compression tab can be longer so that it extends further vertically downwardly than the first compression tab.

The first cylindrical portion can have a larger diameter than the second cylindrical portion. A third cylindrical portion can be disposed vertically between the first cylindrical portion and the second cylindrical portion. The centerline of the first cylindrical portion can be A fastener can be disposed at least partially through the center aperture.

A plurality of anti-slip ribs can be defined on a bottom side of the top portion.

A connecting tab can be provided to frangibly connect to an adjacent decking clip.

In certain example embodiments, a hidden clip assembly can include a plurality of hidden clips arranged in a single strip such that a front or back edge of each clip is attached to at least one front or back edge of an adjacent hidden clip in the single strip, the single strip defining a distal-most hidden clip and a proximal-most hidden clip. A hand grip can be attached to the proximal-most hidden clip in the single strip. The hand grip can comprise a planar portion that extends proximally from the proximal-most hidden clip and a downward extending portion that extends vertically downward from a proximal end of the planar portion.

The planar portion can be aligned in a common horizontal plane with a head portion of each of the plurality of hidden clips. The planar portion of the hand grip can be elongated horizontally in a proximal-distal direction of the single strip. The hand grip can be attached to the proximal-most hidden clip via a frangible attachment tab.

The front or back edge of each clip can be attached to the at least one front or back edge of the adjacent hidden clip in the single strip via a frangible attachment tab.

Each of the plurality of hidden clips can comprise a head portion extending horizontally to define a first edge and a second edge, a stem portion extending downwardly from the head portion, and a center aperture defined through the head portion and the stem portion. The center aperture can define a plurality of cylindrical portions. A first cylindrical portion can be horizontally offset from a second cylindrical portion such that a centerline of the first cylindrical portion does not align with a centerline of the second cylindrical portion.

A first compression tab can extend vertically downwardly from the stem portion. A second compression tab can extend vertically downwardly from the stem portion. The second compression tab can extend further vertically downwardly than the first compression tab.

The first cylindrical portion can have a larger diameter than the second cylindrical portion. A third cylindrical portion can be disposed vertically between the first cylindrical portion and the second cylindrical portion. The centerline of the first cylindrical portion can be aligned with a centerline of the third cylindrical portion.

In certain example embodiments a method of using a hidden clip to install a decking board can include grasping a hand grip portion attached to a proximal-most hidden clip in a strip of multiple hidden clips. Each hidden clip in the strip can be arranged such that a front or back edge of each clip is attached to at least one front or back edge of an adjacent hidden clip in a single strip, the single strip defining a distal-most hidden clip and a proximal-most hidden clip. The hand portion can comprise a planar portion that extends proximally from the proximal-most hidden clip and a downward extending portion that extends vertically downward from a proximal end of the planar portion. A forward edge of a distal-most hidden clip can be inserted within a side groove of a decking board. A fastener can be drive through an aperture defined through the distal-most hidden clip to secure the distal-most hidden clip to a joist and the decking board. The distal-most hidden clip can be severed from a remaining portion of the strip of hidden clips. The fastener can be angled from a vertical axis as the fastener passes through an offset cylindrical portion of the aperture and is driven into the joist.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
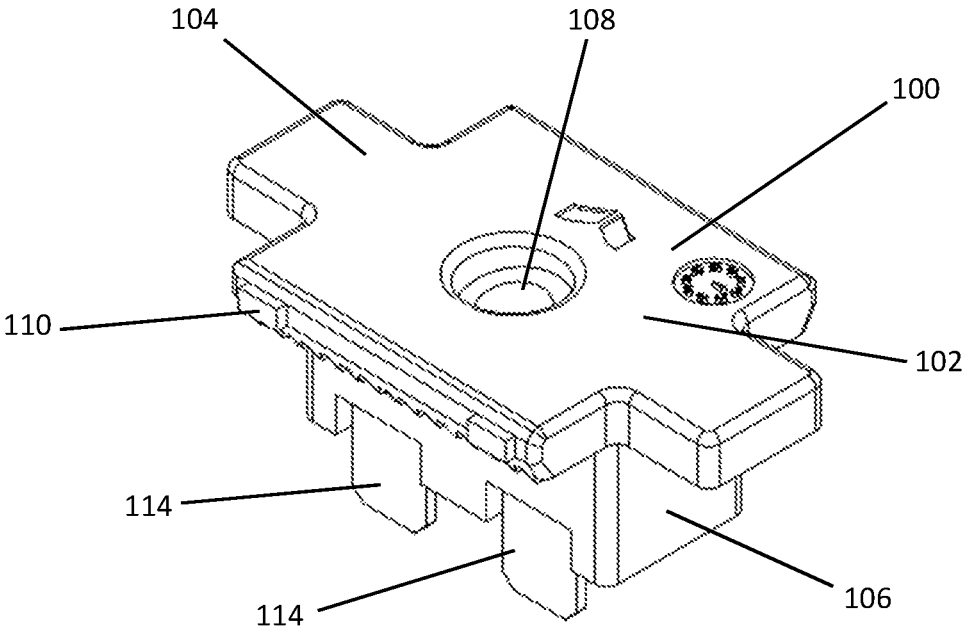
FIG. 1 is a perspective view of a hidden clip in accordance with embodiments of the present invention.
Figure 2:
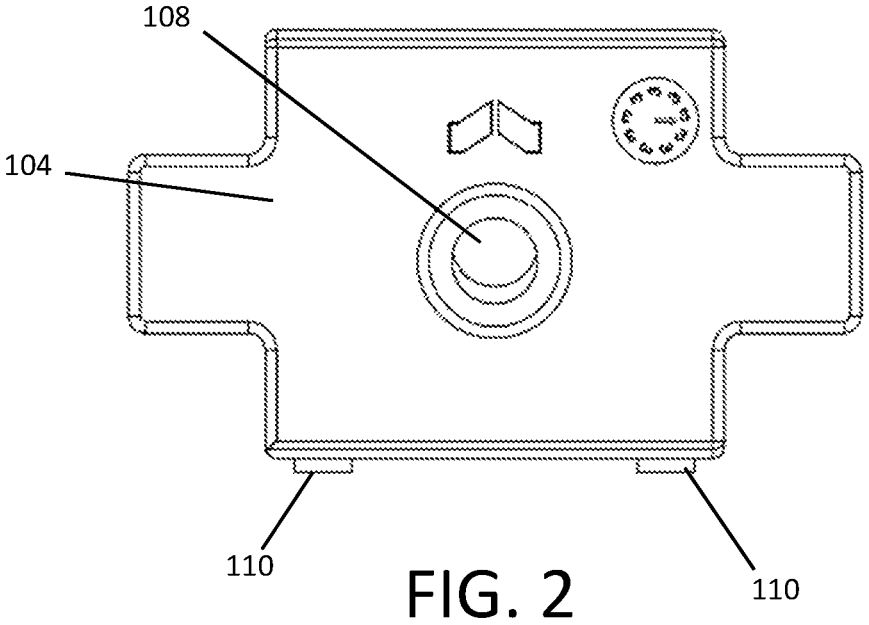
FIG. 2 is a top view of the hidden clip of FIG. 1.
Figure 3:
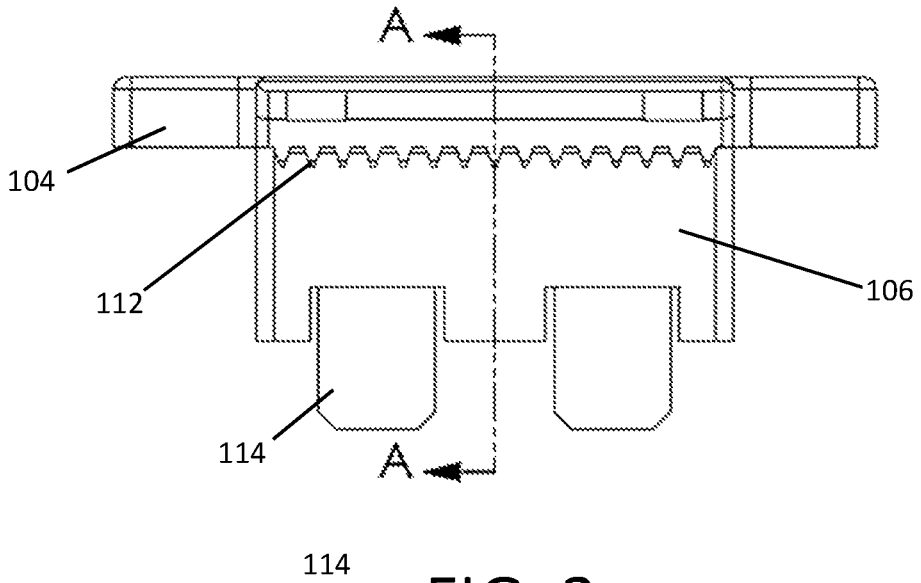
FIG. 3 is a front side view of the hidden clip of FIG. 1.
Figure 4:
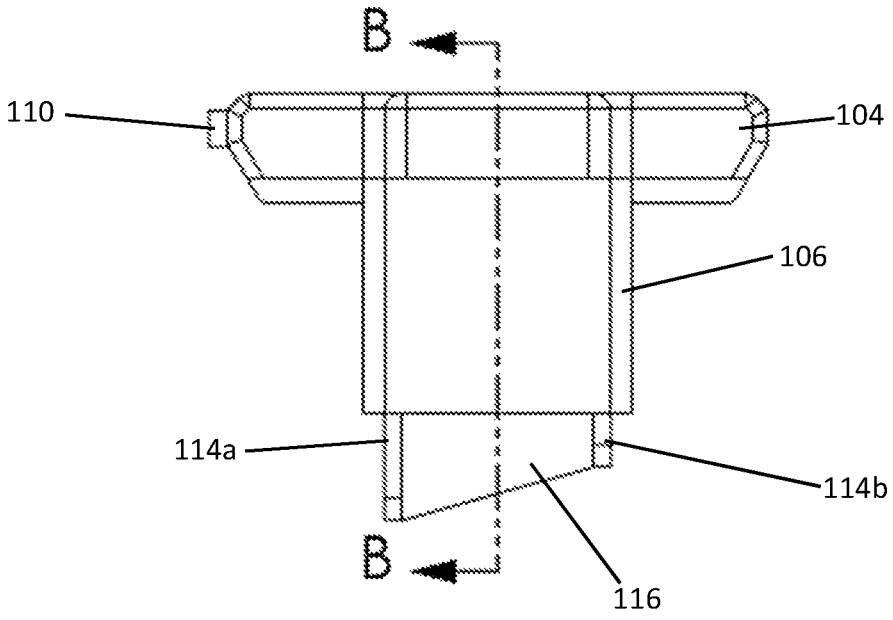
FIG. 4 is a lateral side view of the hidden clip of FIG. 1.

While the invention is amenable to various modifications and alternative forms, specifics thereof have been shown by way of example in the drawings and will be described in detail. It should be understood, however, that the intention is not to limit the invention to the particular exemplary embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to exemplary embodiments thereof. However, these embodiments are not intended to limit the present invention to any specific example, embodiment, environment, applications, or particular implementations described in these embodiments. Therefore, description of these embodiments is only for purpose of illustration rather than to limit the present invention.

Dimensions and relative proportions of components are merely example embodiments and can be varied unless specifically limited in a given claim. Thus, the dimensions can be varied without departing from the scope of the invention.

Referring generally to FIGS. 1-7, the hidden clip 100 comprises a molded plastic (or similar material) body 102 that includes a head portion 104 and a stem portion 106 that extends downwardly from the head portion 104. A center aperture 108 or bore is defined through the entire vertical height of the clip 100 to permit a screw, nail, or other fastener to secure the clip to a deck frame or other surface.

Attachment tabs 110 extend horizontally from a front and/or rear edge of the clip 100 to provide attachment to one or more adjacent clips in a strip of clips, as is shown in FIGS. 8-12.

The bottom side of the top portion 104 of the clip includes or defines a plurality of anti-slip ribs 112.

The attachment tabs 110 can be made very small (e.g., 20 thousandths of an inch or less) so that the tabs 110 do not affect the placement of the clip 100 within the groove of the deck board 106. The attachment tabs 110 in other embodiments can be in the form of a frangible film, either perforated or non-perforated, connecting the adjacent clips. This film in such configuration defines a tear line between adjacent clips.

The stem portion 106 can include one or more compression tabs 114 that extend vertically downward from the stem portion 106. The compression tabs 114 are compressed upward into the stem portion 106 when the clip 100 is secured to the deck frame with a fastener. The compression tabs 114 bite downwards into the joist board for a more secure attachment of the deck boards. As such, both a compression and biting functionality can be facilitated with the compression tabs 114.

In certain embodiments, the anti-slip ribs 112, the compression tabs 114, or both, can be constructed of a harder material (e.g., harder durometer) than the material used to form the head portion 104 and stem portion of the clip 100. Certain portions, such as the stem portion 106, can be formed of a softer material (e.g., softer durometer) than the head portion 104 to promote slip reduction.

A cross-support member 116 can span perpendicular between respective compression tabs 114 at the front and back sides of the stem portion 106.

The compression tabs 114 can be of different lengths (114*a* and 114*b*) on a first side of the stem portion 106 and a second side of the stem portion 106 such that a leading edge of the clip is initially tipped downward as it is set atop the joist and inserted into the groove of the deck board. The cross-support member 116 is correspondingly inclined as it spans perpendicularly between opposing tabs of different lengths.

Figure 15:
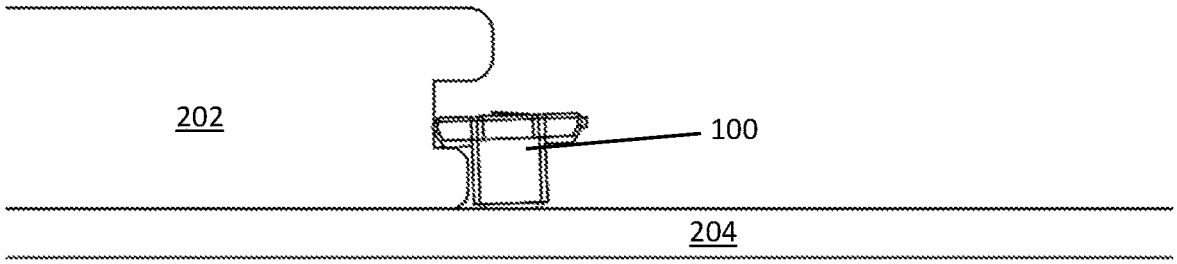
FIG. 15 is a side view of a hidden clip engaged with a deck board and joist in an installed position in accordance with embodiments of the present invention.
Figure 16:
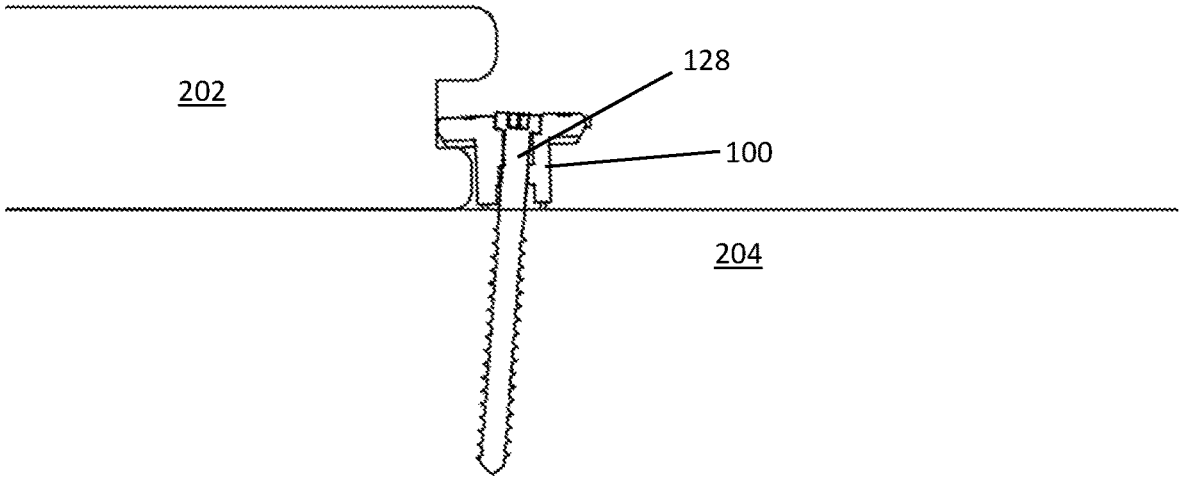
FIG. 16 is a side view of a cross-section of the hidden clip in FIG. 15 engaged with a deck board and joist in an installed position.

This configuration of different length compression tabs 114*a*, 114*b* ensures that the leading edge of the clip 100 is tipped slightly downward as it is secured to the joist and the groove in the deck board (see FIGS. 15-16). This ensures easier placement of the leading edge of the clip 100 into the groove, a tight securement of the leading deck board and an easier placement of the subsequent deck board. The clip is also better able to accommodate variation of the groove height in the deck boards above the bottom surface of the deck board.

Figure 5:
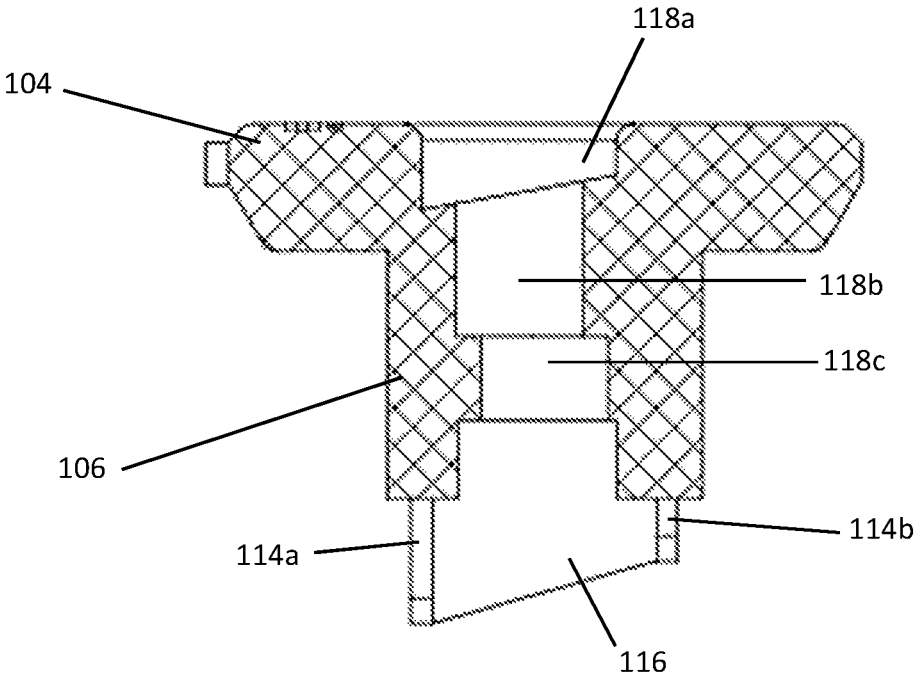
FIG. 5 is a cross-sectional side view of the hidden clip of FIG. 1 along line A-A in FIG. 3.
Figure 6:
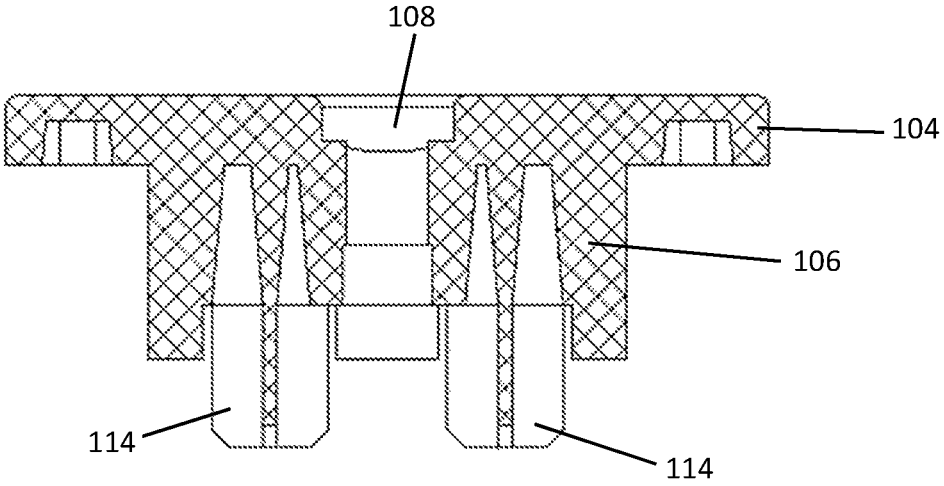
FIG. 6 is a cross-sectional side view of the hidden clip of FIG. 1 along line B-B in FIG. 4.
Figure 7:
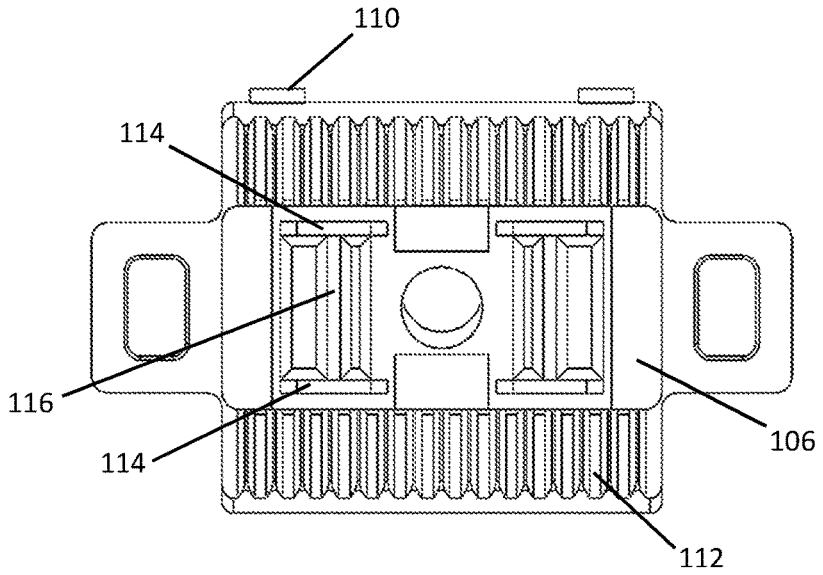
FIG. 7 is a bottom view of the hidden clip of FIG. 1.
Figure 8:
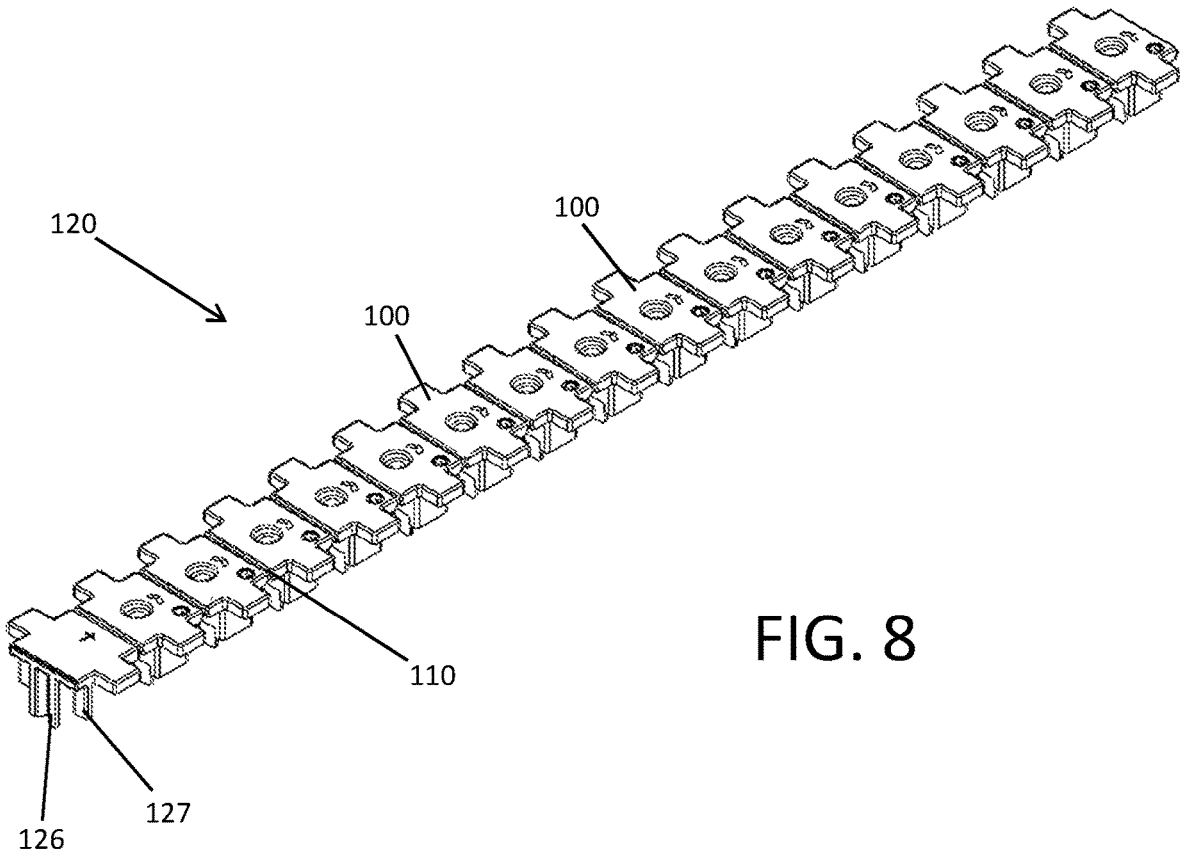
FIG. 8 is a perspective view of a strip of interconnected hidden clips in accordance with embodiments of the present invention.
Figure 9:
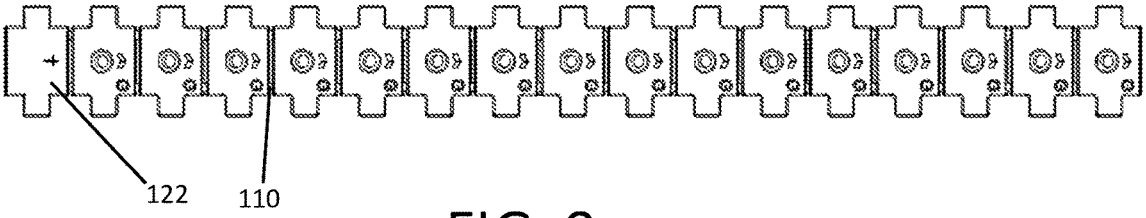
FIG. 9 is a top view of the strip of interconnected hidden clips of FIG. 8.
Figure 10:
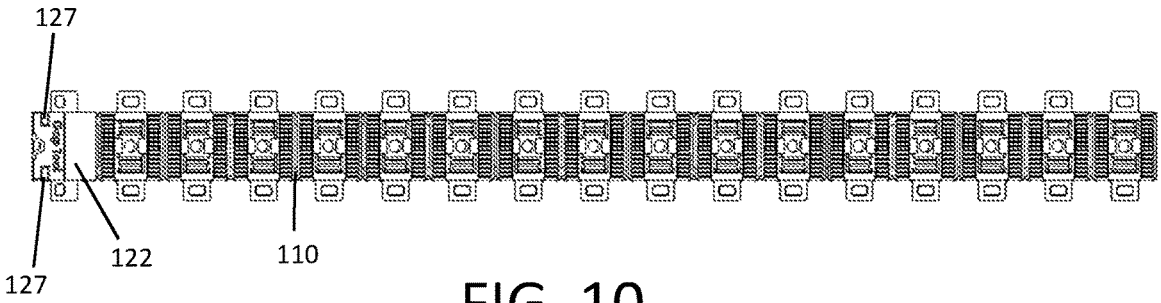
FIG. 10 is a bottom view of the strip of interconnected hidden clips of FIG. 8.
Figure 11:
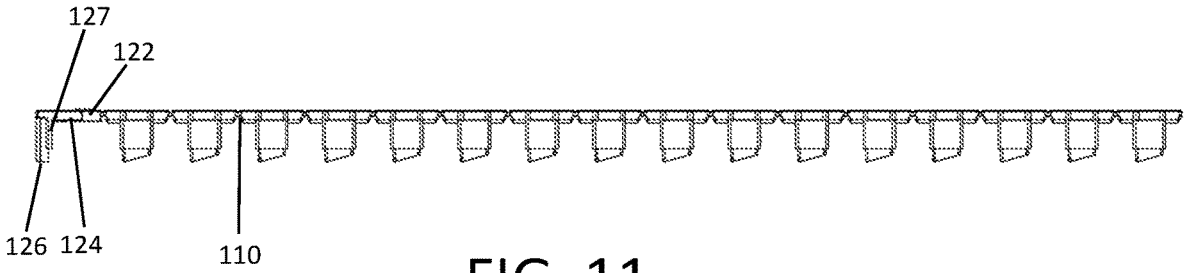
FIG. 11 is a lateral side view of the strip of interconnected hidden clips of FIG. 8.
Figure 12:
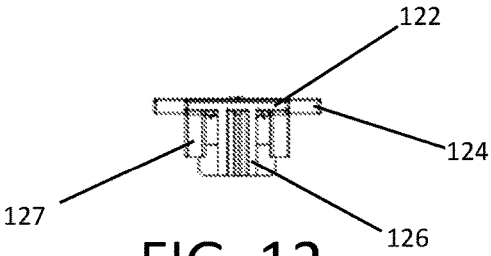
FIG. 12 is a side view of the strip of interconnected hidden clips of FIG. 8 from the grip end.

The center aperture 108 or bore has discontinuities along the inner surface of the aperture. As can be seen in FIG. 5, the aperture 108 defines a plurality of offset cylindrical portions. The vertically uppermost cylindrical portion 118*a* is approximately centered above the middle cylindrical portion 118*b*. However, the upper cylindrical portion 118*a* has a larger diameter than the middle cylindrical portion

118*b*. The lower cylindrical portion 118*c* is partially horizontally offset from the upper 118*a* and middle 118*b* cylindrical portions such that the centerline of the lower cylindrical portion 118*c* is horizontally offset from the upper 118*a* and middle 118*b* cylindrical portions. Moreover, the lower cylindrical portion 118*c* does not extend vertically downward to the maximum extent of the step portion 106. However, the center aperture 108 does continue all the way vertically through the stem portion 106.

FIGS. 8-12 show a plurality of hidden clips 100 in a strip of clips 120. The attachment tabs 110 provide a frangible connection between adjacent clips in the strip 120. Strips of clips can also be greater or fewer in number of clips than that depicted in the figures.

The strip of hidden clips 120 depicted in FIGS. 8-12 is well suited for hand or manual installation due to the inclusion of a hand grip portion or "dummy" clip 122 attached to one ends of the strip 120. The hand grip portion 122 of the strip 120 facilitates the user's handling of the strip 120 during installation of the clips 100 in the strip 120.

The hand grip portion 122 is configured to be manually grasped by the fingers of a user. In particular, the hand grip portion comprises a horizontal planar portion 124 that is aligned vertically with the head portion 104 of the clips 100 and a downward extending portion 126 that extends vertically downward from a proximal end of the planar portion 124. The distal end of the planar portion 124 is attached with attachment tabs 110 to the proximal-most hidden clip 100 in the strip 120.

The planar portion 124 can be the same horizontal width as one of the clips 100, or it can be elongated horizontally in the proximal-distal direction of the strip to provide extra space for grasping by the user's hand, which is especially helpful when the user is wearing a glove.

The downward extending portion 126 can be a flat planar section that extends the width of the top portion 104.

Alternatively, the downward extending portion 126 can be a U-shaped or V-shape leg such as shown in FIGS. 8 and 10-12 with the vertex facing distally (toward an adjacent clip). The proximal ends of the vertically extending portion 126 define a flat surface portion at the proximal end of the hand grip portion 122. Additional downward-extending legs 127 can be provided to the lateral sides of the central downward extending portion 126. The distal surface of the legs 127 are offset slightly distally from the vertex of the vertically extending portion 126. This arrangement provides the user with a gap measurement tool. The proximal-distal distance from the distal surface of the legs 127 to the proximal flat portions of the downward extending portion 126 can define a first gap distance (e.g. ¼ inch). Then, if the user removes the legs 127, a second shorter gap distance is defined between the vertex and flat portions of the downward extending portion 126 (e.g. ⅜ inch). The gap refers to the spacing between two deck boards. Thus, the gap tool feature of the hand grip portion 122 can be used to conveniently set a gap distance for the deck boards during installation.

The clips 100 can be formed of a single material or multiple separate materials. For example, the clips can all comprise single type of plastic material. Alternatively, each clip may comprise multiple different materials in order to provide specialized properties such as those discussed herein.

A fastener 128 can be pre-installed partially within the center aperture 108 of each clip to enhance the conveyance of installation because the user does not need to manipulate and insert a fastener in each clip. The pre-installed fasteners can be inserted shallowly such that the distal threaded end does not extend more than a minimal amount beyond the bottom extent of the clip. The fasteners 128 may be molded to, be part of a stamped clip body, or added to a clip or strip of clips after its manufacture.

A wide variety of fasteners can be used with the clips described herein. For example, the fastener can be a nail, screw, or other suitable fastener. The exemplary fastener depicted in the figures is a screw. Additional example fasteners include concrete screws for fastening the clips to a concrete substrate instead of to wooden joists.

Figure 13:
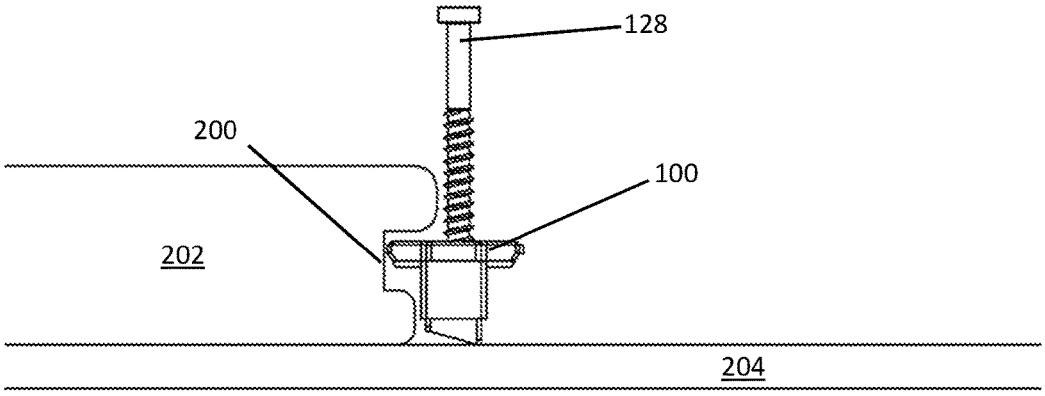
FIG. 13 is a side view of a hidden clip engaged with a deck board and joist in accordance with embodiments of the present invention.
Figure 14:
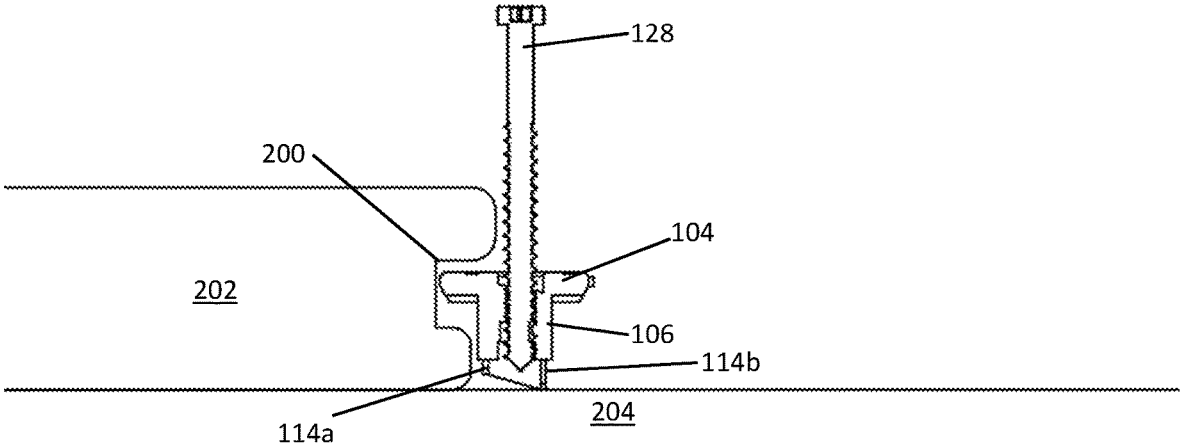
FIG. 14 is a side view of a cross-section of the hidden clip in FIG. 13 engaged with a deck board and joist.

Referring to FIGS. 13-16, in operation, the forward edge of the hidden clip 100 (of the distal-most clip 100 if using a strip 120 of multiple clips) is inserted within the side groove 200 of a decking board 202. As shown in FIGS. 13-14, the compression tabs 114 of the clip 100 sit atop the joist board 204 such that the shorter compression tab 114*a* is located closest to the groove 200. The fastener 128 extends downward vertically through the bore of clip so that it just below the stem portion 106.

As the fastener 128 is driven downward into the joist 204, the clip is caused to tip forward (distally) toward the deck board 202 by the offset lengths of the compression tabs 114*a* and 114*b*. In addition, the offset cylindrical portions 118*a*, 118*b* and/or 118*c* causes the fastener 128 to angle slightly clockwise from the vertical axis as it passes through the center aperture 108 and is driven into the joist 204. Preferably, the cylindrical portions are arranged such that the fastener is inclined as shown in FIG. 16 as the fastener is tightened into the joist.

The angling of the clip 100 and fastener 128 combats or counters the tendency the clip 100 to tilt upon tightening securement, while still promoting biting engagement.

As can be appreciated, the user can utilize the strip of clips 120 with one hand while holding the deck board 202 in place. After a particular clip 100 is secured in place, the operator or user can torque or snap the remaining strip 120 of clips, or otherwise facilitate breaking, of the secured clip from the strip 120 at the respective attachment tabs 110. This process is repeated until the last clip, which is adjacent to the hand grip portion 122, is secured in place. The hand grip portion 122 is then removed from the last clip 100 when that last clip has been secured to the joist. Thus, the installation process requires less installers and installer time. This reduces costs and improves productivity.

The strip of clips can be adapted for use with a power tool and magazine as well, such as is disclosed in US 2018/0223547 A1. For example, the hand grip portion 122 can be removed prior to insertion of the strip into the magazine of a power tool as discussed herein.

US 2018/0223547 A1 and US 2019/0071880 A1 are both fully incorporated herein in their entirety as part of this application.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A hidden clip for deck board fixation, comprising:

a head portion extending horizontally to define a first edge and a second edge;

a stem portion extending downwardly from the head portion; and a center aperture defined through the head portion and the stem portion, wherein the center aperture defines a plurality of cylindrical portions, wherein a first cylindrical portion is horizontally offset from a second cylindrical portion such that a centerline of the first cylindrical portion does not align with a centerline of the second cylindrical portion.

2. The hidden clip of claim 1, further comprising:

a first compression tab extending vertically downwardly from the stem portion; and a second compression tab extending vertically downwardly from the stem portion, wherein the second compression tab extends further vertically downwardly than the first compression tab.

3. The hidden clip of claim 1, wherein the first cylindrical portion has a larger diameter than the second cylindrical portion.

4. The hidden clip of claim 1, further comprising a third cylindrical portion disposed vertically between the first cylindrical portion and the second cylindrical portion.

5. The hidden clip of claim 4, wherein the centerline of the first cylindrical portion is aligned with a centerline of the third cylindrical portion.

6. The hidden clip of claim 1, further comprising a fastener disposed at least partially through the center aperture.

7. The hidden clip of claim 1, further comprising a plurality of anti-slip ribs defined on a bottom side of the top portion.

8. The hidden clip of claim 1, further comprising a connecting tab extending from the head portion to frangibly connect to an adjacent decking clip.

9. A hidden clip assembly, comprising:

a plurality of hidden clips arranged in a single strip of hidden clips attached to one another, the single strip defining a distal-most hidden clip and a proximal-most hidden clip; and a hand grip attached to the proximal-most hidden clip in the single strip, the hand grip comprising a planar portion that extends proximally from the proximal-most hidden clip and a downward extending portion that extends vertically downward from a proximal end of the planar portion, wherein the downward extending portion defines a first leg disposed adjacent to a proximal end of the hand grip attachment and a second leg offset distally from the proximal end of the hand grip attachment.

10. The hidden clip assembly of claim 9, wherein the planar portion is aligned in a common horizontal plane with a head portion of each of the plurality of hidden clips.

11. The hidden clip assembly of claim 9, wherein a proximal-distal distance from the second leg to a proximal-most side of the first leg is greater than a greatest proximal-distal distance of the first leg.

12. The hidden clip assembly of claim 9, wherein the hand grip is attached to the proximal-most hidden clip via a frangible attachment tab.

13. The hidden clip assembly of claim 9, wherein the front or back edge of each clip is attached to the at least one front or back edge of the adjacent hidden clip in the single strip via a frangible attachment tab.

14. The hidden clip assembly of claim 9, wherein each of the plurality of hidden clips comprises:

a head portion extending horizontally to define a first edge and a second edge;

a stem portion extending downwardly from the head portion; and a center aperture defined through the head portion and the stem portion, wherein the center aperture defines a plurality of cylindrical portions, wherein a first cylindrical portion is horizontally offset from a second cylindrical portion such that a centerline of the first cylindrical portion does not align with a centerline of the second cylindrical portion.

15. The hidden clip assembly of claim 14, further comprising:

a first compression tab extending vertically downwardly from the stem portion; and a second compression tab extending vertically downwardly from the stem portion, wherein the second compression tab extends further vertically downwardly than the first compression tab.

16. The hidden clip assembly of claim 14, wherein the first cylindrical portion has a larger diameter than the second cylindrical portion.

17. The hidden clip assembly of claim 14, further comprising a third cylindrical portion disposed vertically between the first cylindrical portion and the second cylindrical portion.

18. The hidden clip assembly of claim 17, wherein the centerline of the first cylindrical portion is aligned with a centerline of the third cylindrical portion.

19. A method of using a hidden clip to install a decking board, the method comprising:

grasping a hand grip portion attached to a proximal-most hidden clip in a strip comprising multiple hidden clips, wherein the hand portion comprises a planar portion that extends proximally from a proximal-most hidden clip and a downward extending portion that extends vertically downward from a proximal end of the planar portion, wherein the downward extending portion defines a first leg disposed adjacent to a proximal end of the hand grip attachment and a second leg offset distally from the proximal end of the hand grip attachment;

inserting a forward edge of a distal-most hidden clip within a side groove of a decking board;

driving a fastener through an aperture defined through the distal-most hidden clip to secure the distal-most hidden clip to a joist and the decking board; and severing the distal-most hidden clip from a remaining portion of the strip of hidden clips.

20. The method of claim 19, further comprising angling the fastener from a vertical axis as the fastener passes through an offset cylindrical portion of the aperture and is driven into the joist.

* * * * *